US006810657B1

(12) United States Patent
Benninger et al.

(10) Patent No.: US 6,810,657 B1
(45) Date of Patent: Nov. 2, 2004

(54) METHOD AND DEVICE FOR TREATING EXHAUST GASES PRODUCED BY AN INTERNAL COMBUSTION ENGINE

(75) Inventors: Nikolaus Benninger, Vaihingen (DE); Horst Harndorf, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 98 days.

(21) Appl. No.: 10/069,644

(22) PCT Filed: Aug. 18, 2000

(86) PCT No.: PCT/DE00/02833

§ 371 (c)(1),
(2), (4) Date: May 16, 2002

(87) PCT Pub. No.: WO01/14697

PCT Pub. Date: Mar. 1, 2001

(30) Foreign Application Priority Data

Aug. 21, 1999 (DE) ..... 199 39 807

(51) Int. Cl.[7] ..... F01N 3/023

(52) U.S. Cl. ..... 60/274; 422/111; 422/178; 423/210; 423/235

(58) Field of Search ..... 60/274, 276, 286, 60/299, 301; 422/110, 111, 113, 177, 178; 423/210, 213.2, 235, 239.1

(56) References Cited

U.S. PATENT DOCUMENTS 6,122,909 A * 9/2000 Murphy et al. ..... 60/286

FOREIGN PATENT DOCUMENTS

| | | | |
|---|---|---|---|
| DE | 42 01 018 A | 7/1993 | |
| DE | 42 08 609 A | 9/2003 | |
| EP | 0758713 A1 * | 2/1997 | ..... F01N/3/08 |
| EP | 0 783 918 A | 7/1997 | |
| EP | 0 869 267 A | 10/1998 | |
| WO | 99 00588 A | 1/1999 | |

OTHER PUBLICATIONS

Patent Abstracts Of Japan vol. 1995, No. 02, Mar. 31, 1995 & JP 06 307232 A, Nov. 1, 1994.
Patent Abstracts Of Japan vol. 1999, No. 04, Apr. 30, 1999 & JP 11 013456 A, Jan. 19, 1999.

* cited by examiner

*Primary Examiner*—Steven Bos
*Assistant Examiner*—Maribel Medina
(74) *Attorney, Agent, or Firm*—Michael J. Striker

(57) ABSTRACT

The invention relates to a method and an apparatus for the post-treatment of exhaust gas produced by an internal combustion engine (1), in particular in a motor vehicle, wherein the following are provided: a hydrolysis unit (10) and a metering device (15) connected to it via a hydrogen line (17) for the metered addition of hydrogen to the untreated exhaust gas (A) and/or to the exhaust gas treated by means of an oxidation catalytic converter (3), and a control/regulating unit (18) that is functionally connected to the hydrolysis unit (10) and the metering device (15) in order to control or regulate the production of hydrogen in the hydrolysis unit (10) and the metering device (15) as a function of certain operating states of the internal combustion engine (1) and registered parameters of the exhaust-gas system (FIG. 1).

16 Claims, 2 Drawing Sheets

METHOD AND DEVICE FOR TREATING EXHAUST GASES PRODUCED BY AN INTERNAL COMBUSTION ENGINE

BACKGROUND OF THE INVENTION

The invention is concerned with a method and an apparatus for the post-treatment of exhaust gas, particularly for lean-burn engines in motor vehicles, e.g., direct-injection diesel engines and gasoline engines, and with ensuring the full functioning of NOx storage catalytic converters in gasoline and diesel engines and particle filters in diesel engines.

With the oxidation catalytic converter located in the exhaust pipe of a modern gasoline or diesel engine using direct injection, SOx deposits in the oxidation catalytic converter impair the desired $NO_2$ formation even to the point of destroying the effectiveness of the catalytic converter system. With NOx storage catalytic converters, $NO_2$ is required for the accumulation process. With particle filters that operate using the CRT (continuously regeneration trap) method, $NO_2$ is required for the continuously-occurring oxidation regeneration process of the soot particles. When sulphur contaminates the NOx storage catalytic converter, the desired $NO_2$ accumulation is reduced by SOx deposits in the NOx adsorber resulting from the sulphur in the fuel until the effectiveness of the system is destroyed. This sulphur compound can be broken down by regenerating the storage catalytic converter by briefly applying elevated exhaust-gas temperatures (a temperature above 650° C. is used in gasoline direct-injection engines). The realization of such exhaust-gas temperatures in diesel engines is not considered promising according to the related art. Particle filters that function according to the CRT method mentioned hereinabove require exhaust-gas temperatures that exceed 230° C. for the continuously-occurring regeneration process. These conditions cannot always be met with direct-injection diesel engines. Consequently, the filter can become severely overloaded, which can destroy the particle filter.

In the process of regenerating NOx storage catalytic converters, CO resulting from the hydrocarbon in the fuel must be added, and, at the same time, a rich composition of exhaust gas ($\lambda<1$) must be produced. With diesel engines, however, it is atypical for the hydrocarbons (HC) required for regeneration to be provided by means of internal processes, due to the principles involved; it is also extremely crucial and associated with considerable reductions in fuel economy. Process-gas flow rates are a great deal higher with the diesel engine than with the gasoline engine. As a result, the temperatures required for regeneration cannot be reached across the entire operating range.

Likewise, providing a "rich" composition of exhaust gas post-combustion is also a problem with diesel engines, because an oxidation catalytic converter is required to form CO, an exhaust-gas temperature profile is not entirely sufficient, and cycles with rich exhaust gas can only be achieved using a by-pass system.

SUMMARY OF THE INVENTION

The object of the invention is to prevent the hereinabove-mentioned difficulties associated with the post-treatment of exhaust gas in modern lean-burn engines, particularly gasoline and diesel engines with direct injection in motor vehicles, and to provide a method and an apparatus for the post-treatment of exhaust gas produced by an internal combustion engine in such a fashion that the exhaust-gas temperature is raised as necessary, and the exhaust-gas quality is improved overall—especially under certain operating conditions of the internal combustion engine—while not making the engine acoustics worse, and while making regeneration of a storage catalytic converter and/or a particle filter possible at regular intervals and/or after sulphur poisoning at the oxidation stages of an NOx storage catalytic converter and particle filter.

According to an essential aspect, with the method according to the invention for the post-treatment of exhaust gas, a hydrolysis unit for obtaining hydrogen is provided that is connected to a water tank as well as a metering device that is designed to meter the hydrogen delivered to the untreated exhaust gas and/or to the exhaust gas treated by means of an oxidation catalytic converter as a function of a demand for hydrogen occurring at certain operating states and/or catalytic converter functions.

In an exemplary embodiment of the method, the quantity of hydrogen required in each case can be produced on demand, i.e., discontinuously, in the hydrolysis unit, and can then be made available directly for metering.

In an alternative exemplary embodiment of the method, a hydrogen tank can be provided that serves to provide intermediate storage for a certain quantity of the hydrogen produced by the hydrolysis unit.

The size of the hydrogen tank and, therefore, the quantity of the hydrogen stored for the interim, can thereby be designed so that it suffices to heat and regenerate an NOx storage catalytic converter.

When the connecting pipes between the metering device and the hydrolysis unit are designed accordingly, the tank can be represented by the inner lumen of the pipeline.

Preferably, the temperature of the untreated exhaust gas, the $\lambda$ value and, in addition, certain operating states of the catalytic converter system, are registered to meter the hydrogen to be delivered.

In the case of a diesel engine, especially with direct injection, the addition of hydrogen to the exhaust gas is activated when hydrocarbon cannot be produced using internal processes.

In the case of a gasoline engine, especially one with direct injection, the addition of hydrogen to the exhaust gas is activated when the engine operating point at the moment does not allow hydrocarbon to be provided using internal processes at a sufficient temperature.

The method according to the invention can be used to restore a sufficient conversion rate after sulphur poisoning at the oxidation stages of an NOx storage catalytic converter or a particle filter by regenerating the oxidation stages of the storage catalytic converter or the particle filter by means of hydrogen reduction. Regeneration by means of adding hydrogen can always be activated when a decrease in the conversion rate of the NOx storage catalytic converter or the particle filter is registered.

When an internal combustion engine operates under low-load conditions and temperature is therefore a crucial factor, adding hydrogen in accordance with the invention can raise the exhaust gas temperature in order to guarantee that the regeneration conditions are met during low-load operation of the engine when a particle filter is employed.

In an apparatus for the post-treatment of exhaust gas produced by an internal combustion engine, especially in a motor vehicle, that attains the object described hereinabove, the following are provided: a hydrolysis unit and a metering device connected to it via a hydrogen line for the metered addition of hydrogen to the untreated exhaust gas and/or to the exhaust gas treated by means of the oxidation catalytic converter, and a control and regulating unit that are functionally connected to the hydrolysis unit and the metering device, in order to control or regulate the production of hydrogen in the hydrolysis unit and the metering device as a function of certain operating states of the internal combustion engine and registered parameters of the exhaust-gas system.

The metering device is preferably a metering and shutoff valve.

The control/regulating unit preferably comprises a catalytic converter monitoring function that is functionally connected to an exhaust-gas sensor system.

The above-mentioned and further advantageous features of the method according to the invention and the apparatus according to the invention are explained in the subsequent description of preferred exemplary embodiments of the method according to the invention and the apparatus according to the invention, with reference to the drawings.

DESCRIPTION OF THE PREFERRED EMBODIMENTS

Figure 1:
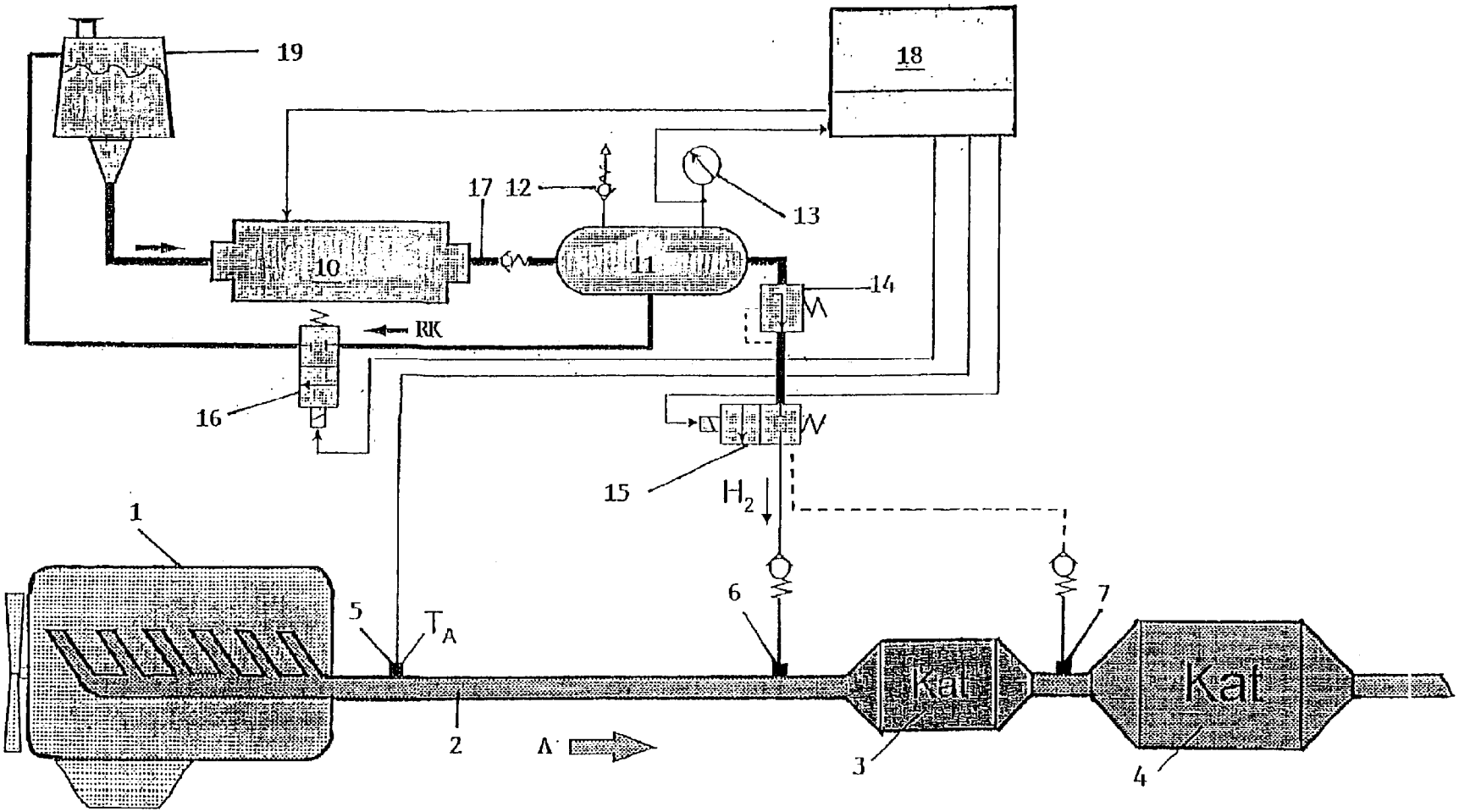
FIG. 1 is a schematic drawing, in the form of functional blocks, of a first exemplary embodiment in which the method according to the invention for the post-treatment of exhaust gas is employed in an internal combustion engine outfitted with an NOx storage catalytic converter in the exhaust-gas system.

FIG. 1 shows a schematic diagram of blocks that illustrate the essential functions and elements of a first exemplary embodiment of the method according to the invention. A hydrolysis unit 10 produces a certain quantity of hydrogen ($H_2$) on demand from water drawn from a water tank 19, which is through a hydrogen line 17 via a pressure reducing valve 14 to a metering and shutoff valve 15 and, from there, is added to the untreated exhaust gas at a point 6 and/or to the exhaust gas treated by an oxidation catalytic converter 3 at a point 7 in an exhaust-gas line 2 leading away from an internal combustion engine 1. The arrow A indicates the direction of flow of the exhaust gas. An NOx storage catalytic converter 4 is located in the exhaust-gas line 2, downstream of the oxidation catalytic converter 3.

The $H_2$ gas produced by the hydrolysis unit 10 can either be produced on demand in the quantity required at the moment, or a hydrogen tank 11 can be connected between the hydrolysis unit 10 and the pressure reducing valve 14, from which a condensate return line RK leads to the water tank 19 via a shutoff valve 16. A pressure sensor 13 is connected to the hydrogen tank 11 that serves to provide intermediate storage. In addition, a safety valve 12 is attached to the hydrogen tank 11. If necessary, the hydrogen tank 11 can also be represented by the inner lumen of the $H_2$ line 17.

The metering and shutoff valve can be designed so that the hydrogen flowing to the point 5, i.e., the portion of hydrogen added to the untreated exhaust gas and the portion of hydrogen added to the exhaust gas after the oxidation catalytic converter 3 (at point 7), can be metered separately if necessary.

FIG. 1 further shows that a control/regulating unit 18 comprises an interface that is connected to the hydrolysis unit 10, the pressure sensor 13 of the hydrogen tank 11, the metering and shutoff valve 15, the shutoff valve 16 and to a temperature sensor 5 measuring the exhaust-gas temperature $T_A$. The control/regulating unit 18 is designed to control and regulate the production of hydrogen in the hydrolysis unit 10 and the metering device 15 as a function of certain operating states of the internal combustion engine 1 and as a function of registered parameters—including the exhaust-gas temperature $T_A$—of the exhaust-gas system.

When the internal combustion engine 1 outfitted with the apparatus for the post-treatment of exhaust gas is a direct-injection gasoline engine, for example, the method according to the invention can be applied in various fashions:

1. $H_2$ is added to the untreated exhaust gas (at point 6) to represent the regeneration phases when an NOx storage catalytic converter 4 is employed (at intervals of approximately 1×per minute) if the engine operating point at the moment does not allow HC to be made available using internal processes at a sufficient temperature. The control of the regeneration process by means of the control/regulating unit 18 takes place analogous to NOx catalytic converter control employed in gasoline direct-injection engines.

2. A sufficient rate of conversion is restored after sulphur poisoning occurs at the oxidation stages of the NOx storage catalytic converter 4. This is required, after a few hours of operation, for example, depending on the sulphur content of the fuel. The control of the regeneration process by means of the control/regulating unit 18 takes place after a decrease in the conversion rate is registered. The control/regulating unit 18, which is connected to an appropriate catalytic converter sensor system, comprises a catalytic converter monitoring function for this purpose.

Figure 2:
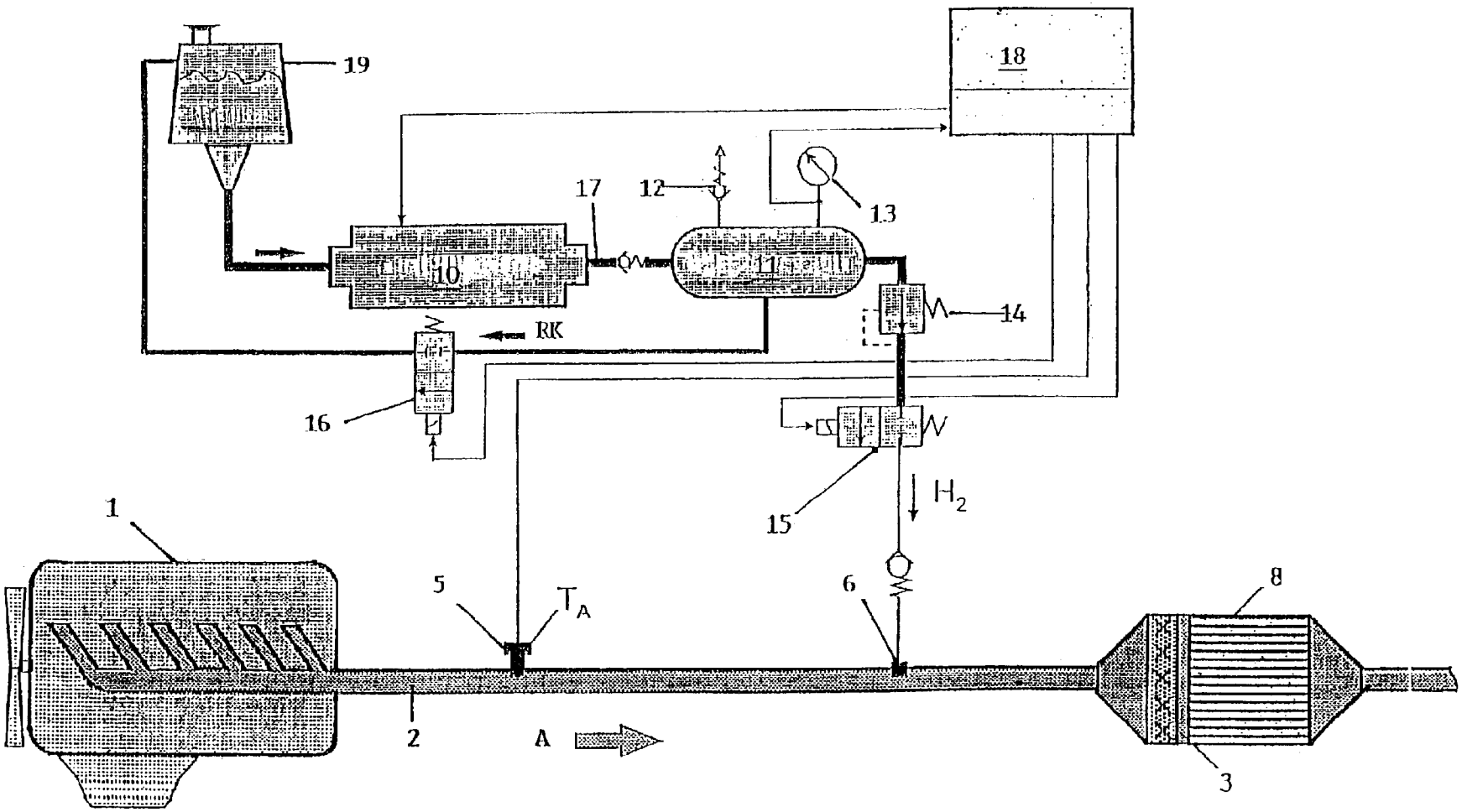
FIG. 2 is a schematic drawing as well, in the form of a functional block connection diagram, of a second exemplary embodiment, in which the method according to the invention for the post-treatment of exhaust gas is employed in an internal combustion engine outfitted with a CRT particle filter in the exhaust-gas system.

FIG. 2 presents a second exemplary embodiment, in which the method according to the invention is employed in a motor vehicle engine, e.g., a diesel engine with direct injection, outfitted with a CRT particle filter for the post-treatment of exhaust gas. A particle filter 8 of this type, as shown in FIG. 2, is located in the exhaust pipe 2 of the direct-injection diesel engine 1. An oxidation catalytic converter 3 is installed upstream of the CRT particle filter 8. The hydrogen produced by the hydrolysis unit 10 and metered in an appropriate quantity by the metering and shutoff valve 15 is added at point 6 to the untreated exhaust gas that flows through the exhaust pipe 2 (arrow A). All other structural details of the apparatus shown in FIG. 2 are of the same type as shown hereinabove in FIG. 1.

A distinction is made between numerous applications here as well:

1. With a diesel engine, $H_2$ is added to the untreated exhaust gas to represent the regeneration phases of the particle filter 8 if HC cannot be generated using internal processes. The regeneration process is controlled analogously to the NOx catalytic converter control employed in gasoline direct injection engines.

2. With diesel engines, a sufficient rate of conversion can be restored after sulphur poisoning of the particle filter 8 occurs by employing the method according to the invention. This is necessary, e.g., after a few hours of operation, depending on the sulphur content of the fuel. Control of the regeneration of the particle filter 8 can begin after a decrease in the conversion rate is registered. A catalytic converter monitoring function is integrated in the control/regulating unit 18 for this purpose.

3. The exhaust-gas temperature can be raised by introducing hydrogen according to the invention to guarantee the regeneration conditions are met when the particle filter 8 is employed when the engine operates under low-load conditions, and temperature is therefore a crucial factor.

The $H_2$ tank 11 is provided only as an option in FIG. 2 as well. Instead of this, an $H_2$ pipe with a sufficient inner lumen can replace the $H_2$ tank 11 which serves to provide intermediate storage.

Taken together, the method according to the invention for the post-treatment of exhaust gas produced by an internal combustion engine, especially in a motor vehicle, serves to raise the temperature of the exhaust gas and the catalytic converter, which is necessary in particular when the engine is cold and when it operates under low-load conditions. Furthermore, hydrogen can be produced "on-board" and during transient operation using the method according to the invention and added to the catalytic converter or the particle filter via the metering and shutoff valve 15 as needed and depending on the specific case at hand. In contrast to generation of HC using internal processes, which requires the presence of a common rail injection system, the quality of the exhaust gas—and the rate of particulate emissions in particular—and the engine acoustics are not made even worse. In addition, the response behavior of the systems is much faster when hydrogen is added.

What is claimed is:

1. A method for regeneration of a particle filter in a motor vehicle, comprising the steps of obtaining hydrogen by a hydrolysis unit connected to a water tank; delivering a metered addition of the hydrogen to an exhaust gas as a function of a demand for hydrogen occurring at certain operating states and/or functions of a catalytic converter; performing the delivery of the hydrogen in a direction of flow of exhaust gas at a location upstream of an oxidation catalytic converter and the particle filter of an exhaust-gas line.

2. The method as defined in claim 1; and further comprising producing a quantity of hydrogen required in each case on demand in the hydrolysis unit; and making available directly for metering.

3. The method as defined in claim 2; and further comprising providing a hydrogen tank that stores a certain quantity of the hydrogen produced by the hydrolysis unit.

4. The method as defined in claim 3; and further comprising dimensioning a quantity of hydrogen in the tank so that it suffices to heat and regenerate the NOx storage catalytic converter disposed downstream of the particle filter.

5. The method as defined in claim 1; and further comprising registering a temperature of the exhaust gas and certain operating states of the catalytic converters.

6. The method as defined in claim 1; and further comprising providing regeneration phases in the NOx storage catalytic converter including adding hydrogen to an untreated exhaust gas at certain intervals and in a quantity required in each case.

7. The method as defined in claim 1; and further comprising for the internal combustion engine formed as a diesel engine, activating an addition of hydrogen to the exhaust gas when hydrocarbon can not be produced using internal processes.

8. The method as defined in claim 1; and further comprising for the internal combustion engine formed as a gasoline engine, initiating an addition of hydrogen to the exhaust gas when an engine operating point at a moment does not allow hydrocarbons to be made available using Internal processes at a sufficient temperature.

9. The method as defined in claim 1; and further comprising regenerating oxidation stages of the storage catalytic converter or the particle filter by means of hydrogen reduction, to restore a sufficient conversion rate after sulfur poisoning, at oxidations stages at the NOx storage catalytic converter or the particle filter.

10. The method as defined in claim 9; and further comprising activating the regeneration after a decrease in a conversion rate of the NOx storage catalytic converter or the particle filter is registered.

11. The method as defined in claim 1; and further comprising raising an exhaust-gas temperature in order to guarantee that regeneration conditions are met when the particle filter is employed while the engine operates under a low-load condition and temperatures for the low-load condition are a crucial factor.

12. The method as defined in claim 1; wherein the regeneration is controlled by a control/regulating unit as a function of a sulfur content of fuel.

13. An apparatus for a post-treatment of an exhaust gas of an internal combustion engine In a motor vehicle, comprising a hydrolysis unit, a metering device connected to said hydrolysis unit via a hydrogen line for a metered addition of hydrogen to an exhaust gas; and a control/regulating unit that is functionally connected to said hydrolysis unit and said metering device in order to control or regulate a production of hydrogen in said hydrolysis unit and said metering device as a function of certain operating states of the internal combustion engine and registered parameters of an exhaust-gas system; and additional points at which hydrogen is added to the exhaust gas in the exhaust-gas line in a direction of flow of the exhaust gas at a location upstream of an oxidation catalytic converter and a particle filter.

14. The apparatus as defined in claim 13; wherein said metering device is formed as a metering and shutoff valve.

15. The apparatus as defined in claim 13; and further comprising a hydrogen Intermediate storage tank connected downstream of said hydrolysis unit in order to store a certain quantity of hydrogen.

16. The apparatus as defined in claim 13; wherein said control/regulating unit comprises a catalytic converter monitoring function that is functionally connected to an exhaust-gas sensor system.

* * * * *